US009242348B2

(12) United States Patent
Royal

(10) Patent No.: US 9,242,348 B2
(45) Date of Patent: Jan. 26, 2016

(54) INTERLOCKING CLAMP

(76) Inventor: Jeremy Patrick Royal, Grand Island, NY (US)

( * ) Notice: Subject to any disclaimer, the term of this patent is extended or adjusted under 35 U.S.C. 154(b) by 424 days.

(21) Appl. No.: 13/337,205

(22) Filed: Dec. 26, 2011

(65) Prior Publication Data

US 2014/0001691 A1 Jan. 2, 2014

(51) Int. Cl.

| | |
|---|---|
| ***B25B 5/00*** | (2006.01) |
| ***B25B 5/10*** | (2006.01) |
| *B25B 11/00* | (2006.01) |
| *B25B 11/02* | (2006.01) |

(52) U.S. Cl.

CPC ..... *B25B 5/003* (2013.01); *B25B 5/102* (2013.01); *B25B 11/00* (2013.01); *B25B 11/02* (2013.01)

(58) Field of Classification Search

CPC ..... B25B 11/00; B25B 11/02; B25B 5/003; B25B 5/006; B25B 5/102; B25B 5/145; B25B 5/10; B25B 5/068

USPC ..... 269/45, 37, 41, 44, 104, 109, 64, 69, 269/249, 97

See application file for complete search history.

(56) References Cited

U.S. PATENT DOCUMENTS

| | | | | |
|---|---|---|---|---|
| 1,352,647 | A * | 9/1920 | Benton | 269/64 |
| 5,427,465 | A * | 6/1995 | Sato | 403/49 |
| 2011/0089621 | A1* | 4/2011 | Seidel | B25B 5/003 269/46 |

* cited by examiner

*Primary Examiner* — Monica Carter
*Assistant Examiner* — Seahee Yoon
(74) *Attorney, Agent, or Firm* — Brown & Michaels, PC

(57) ABSTRACT

The present invention allows multiple bar or c-clamps to be connected by one or more bars, the bars passing through the head and/or feet of the clamps, with provisions for locking the angles of the clamps about the bars joining them. This allows temporary jigs to be quickly assembled, with the angles of the workpieces held by the clamps to be fixed relative to one another at specified angles. In addition, parallelism of clamps holding a single workpiece may be maintained through the use of two or more connecting bars.

11 Claims, 9 Drawing Sheets

INTERLOCKING CLAMP

REFERENCE TO RELATED APPLICATIONS

Not Applicable

ACKNOWLEDGMENT OF GOVERNMENT SUPPORT

Not Applicable

MICROFICHE APPENDIX

Not Applicable

BACKGROUND OF THE INVENTION

1. Field of the Invention

The invention pertains to the field of bar and c-clamp type tools used for holding two or more workpieces at fixed angles to each other. More particularly, the invention pertains to an improvement to clamps to allow two or more clamps to be joined at fixed angles to each other while they hold a workpiece or workpieces.

2. Description of Related Art

Bar clamps, C-clamps, and related tools, typically exert their force along one line. While much prior art has been devoted to immobilization of workpieces and clamps relative to the plane of the workpieces, there has been little work done in joining bar or c-clamps rigidly in a manner that allows them to exert force on a joint along multiple lines. Clamping at right angles to another bar clamp is usually done with the geometry of the second clamp being unfixed relative to the first clamp. Further, special jigs are needed to maintain multiple clamps parallel to each other in situations where such precision is desired.

Numerous systems have been developed to create "universal" clamps that allow clamping along more than one axis (U.S. Pat. No. 4,125,251), to clamp at right angles to a frame (U.S. Pat. No. 6,491,294), and to interconnect c-clamps for building complex clamping jigs (U.S. Pat. No. 4,747,590). Miter clamps and strap clamps have been developed to allow additional clamping geometries. Each approach has a weakness. Some do not allow assembly of interconnecting clamps on more than one plane, or require threaded bar stock to do so, with commensurately longer setup time. Some systems are comprised of specially made clamping blocks that are not useful without other components. Some are specialized for one joint type and are useless for clamping other joints. Many of these specialized clamps are not useful for basic clamping tasks that bar and c-clamps are used for.

In addition to variations on bar and c-clamps, there are a large number of clamping "systems" that are designed to be used for a wide variety of clamping situations. These systems may be for 2-dimensional clamping tasks, such as U.S. Pat. No. 4,125,251, which fixes clamped objects on a table, or complicated 3-dimensional clamping tasks, such as U.S. Pat. No. 3,883,128 and U.S. Pat. Nos. 4,747,590 and 4,753,425. Some clamp systems such as the latter use threaded connectors between clamps, which have the advantage of strongly fixing the distance between clamps at the cost of time-consuming setup.

To allow clamps to be quickly used in unison with one another while maintaining their individual usefulness, c-clamps have been developed that join at the bar connecting their jaws, as in U.S. Pat. No. 2,636,527, miter clamps have been developed that can pivot on a rod through the bar connecting their jaws, as in U.S. Pat. No. 994630, and clamps that can pivot on a rod through the bar connecting their jaws, capable of maintaining fixed angles, as in U.S. Pat. No. 1,352,647. These designs generally cannot interlock the component clamps in such a way as to permit multiple clamps to act in parallel on a large, flat workpieces, such as is often required in cabinetmaking.

This defect is not shared by U.S. Pat. No. 4,607,829 which comprises c-clamps with two holes on each jaw as well as the (fixed) bar that connects the jaws. These holes are aligned so as to allow the clamps to be fastened together in a variety of configurations, including in parallel and at fixed 90 or 45 degree angles to a flat workpiece. U.S. Pat. No. 4,607,829 does not, however, include any mechanism to lock or vary the angle of the clamping axes other than that provided by the two fasteners joining adjacent clamps and the fixed geometry of the clamp bodies, and requires a spacer or shim to join clamps in parallel at a distance from each other along the connecting bolts. In addition, there is no provision for the use of f-clamps with this mechanism.

SUMMARY OF THE INVENTION

This invention comprises an improvement to bar and c-clamps to allow them to be temporarily coupled in such a way as to render them fixed at specified angles to each other in a plane perpendicular to that of the workpiece. This allows the assembly of temporary clamping fixtures (jigs) from multiple clamps, allowing more precise control of workpiece and joint geometry. Rather than using external tools or other measures to control this geometry, the alignment hardware is largely internal to clamps equipped with this invention, allowing greater simplicity of clamp hardware. An angle of the jaws of the clamps is fixed by one or more of the following: lugs on the clamp heads and feet, a fixed profile hole in the clamp heads and feet, bar stock connecting selected clamp heads and feet, and a locking mechanism in the clamp heads and feet that applies force to the connecting bar stock.

The invention does not require use of threaded components to connect clamps. Using threaded components to maintain distance between clamps can greatly increase setup time, particularly for larger arrangements of clamps and connecting parts. The invention uses for this purpose unthreaded metal bar stock, which is more easily obtained than custom components. As the length of the bar stock need not be tailored to a given jig or arrangement of clamps, setup is easier than with threaded rod or other components that require cutting before use.

Clamps designed with this invention may be used as basic bar or c-clamps, fulfilling the same uses of non-modified clamps with no loss of function and a minimal loss of rigidity.

DETAILED DESCRIPTION OF THE INVENTION

This invention consists of several improvements to of bar and c-clamps, allowing them to connect to each other in such a way as to fix the geometry between clamps. Both bar and c-clamps have a head and a foot between which one or more workpieces are clamped. It is to and between these parts of the clamps that this invention is applied. As such, the invention can be used to improve many of the numerous types of bar and c-clamps, whose previous various innovations are primarily concerned with locking mechanisms used to immobilize the head and foot relative to each other along the clamping axis.

Figure 1:
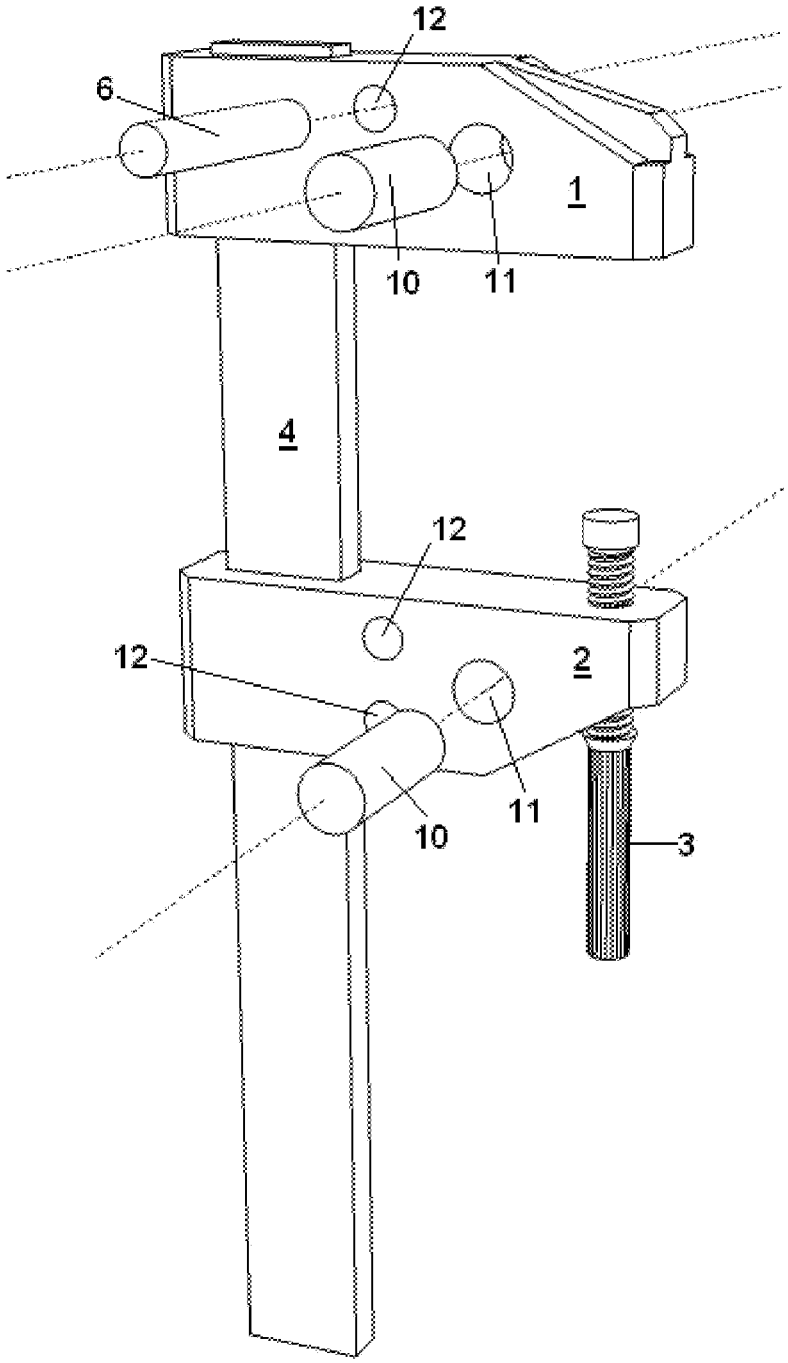
FIG. 1 shows a perspective view of a single F-style bar clamp with removable cylindrical lugs.

Referring to FIG. 1, the basic elements of an F-type bar clamp include 1 the head of the clamp, 2 the foot of the clamp, 3 a tensioning mechanism that permits the exertion of a compressive force perpendicular to the head 1 and foot 2 of the clamp, in this example a screw and handle, and 4, a bar or connecting structure along which one or both of the head and foot may move. Commonly in F-type bar clamps, 1 is fixed along connecting structure 4 and 2 may move along 4 until somehow locked. In FIG. 1, the embodiment of the invention that has been applied encompasses lugs 6 and holes 12 that permit temporary joining of 6 to 1 and 2, as well as 10, a bar that can pass through 11, a hole in 1 and 2. The shape of 6 and location of 12 is determined by the geometry of 1, 2, and 11 as well as the angle desired to be maintained between clamps mounted adjacent to one another along a common connecting bar 10. Note that the invention that has been applied does not interfere with conventional, standalone use of the F-type bar clamp, instead adding additional capabilities while not removing any.

Figure 2:
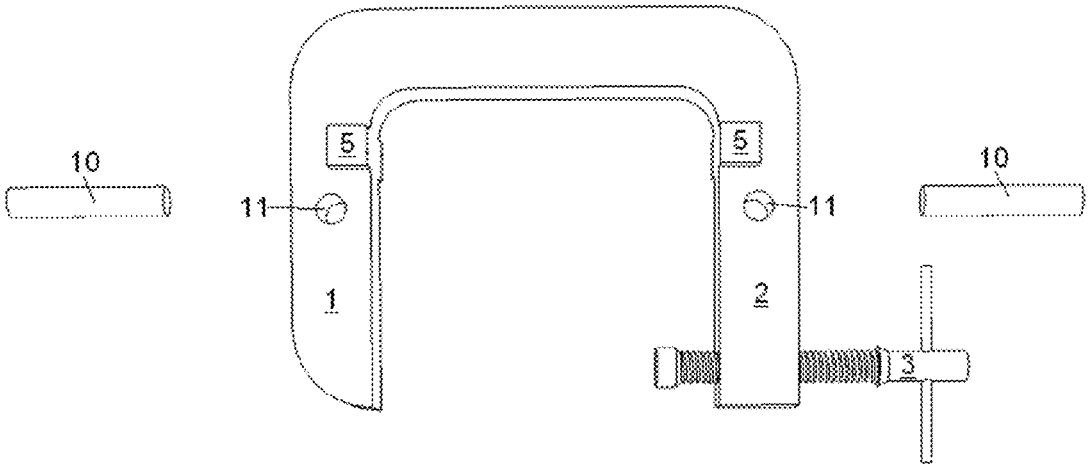
FIG. 2 shows a plan view of a C-clamp with fixed side lugs.

In both FIG. 2, the embodiment of the invention that has been applied encompasses lugs 5, permanently affixed to clamp head 1 and foot 2, 10, a connecting bar that can pass through 11, a hole in clamp head 1 and clamp foot 2. As with the temporarily affixed lugs 6 in FIG. 1, the geometry of the permanently affixed lugs 5 is determined by geometry of clamp head 1, clamp foot 2, the hole 11 and the angle desired to be maintained between clamps mounted adjacent to one another along a common connecting bar 10.

Figure 3:
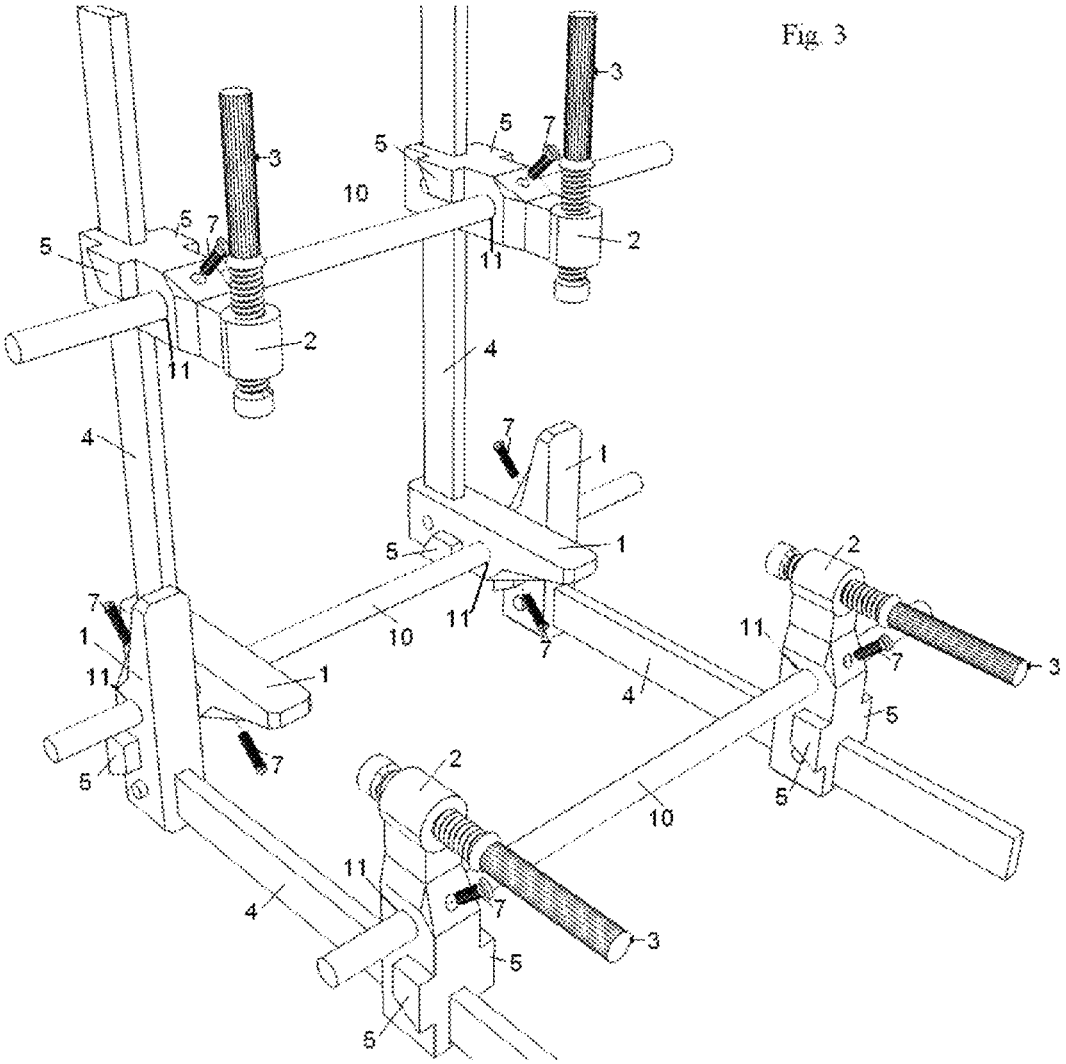
FIG. 3 shows a perspective view of 4 F-style bar clamps with fixed side lugs and screw locks, illustrating how they may be joined for use as a 90 degree clamping jig.

Jigs or fixtures made from a number of clamps may be assembled to improve control of larger or more complicated workpieces. FIG. 3 is an illustration of 4 clamps joined with connecting bars 10 to make a large jig, at a 90 degree angle. This angle is maintained by lugs 5 engaging the clamp heads 1 to prevent rotation of the clamps past a 90 degree angle. The depicted jig has the advantage over separate clamps that parallelism is maintained between clamps acting in the same direction in this jig, while separate clamps applied individually could apply force in divergent directions due to improper operator use. Because the clamps can slide along the connecting bars 10, many clamps can be situated along these bars, permitting greater control of the workpieces being clamped.

Figure 4:
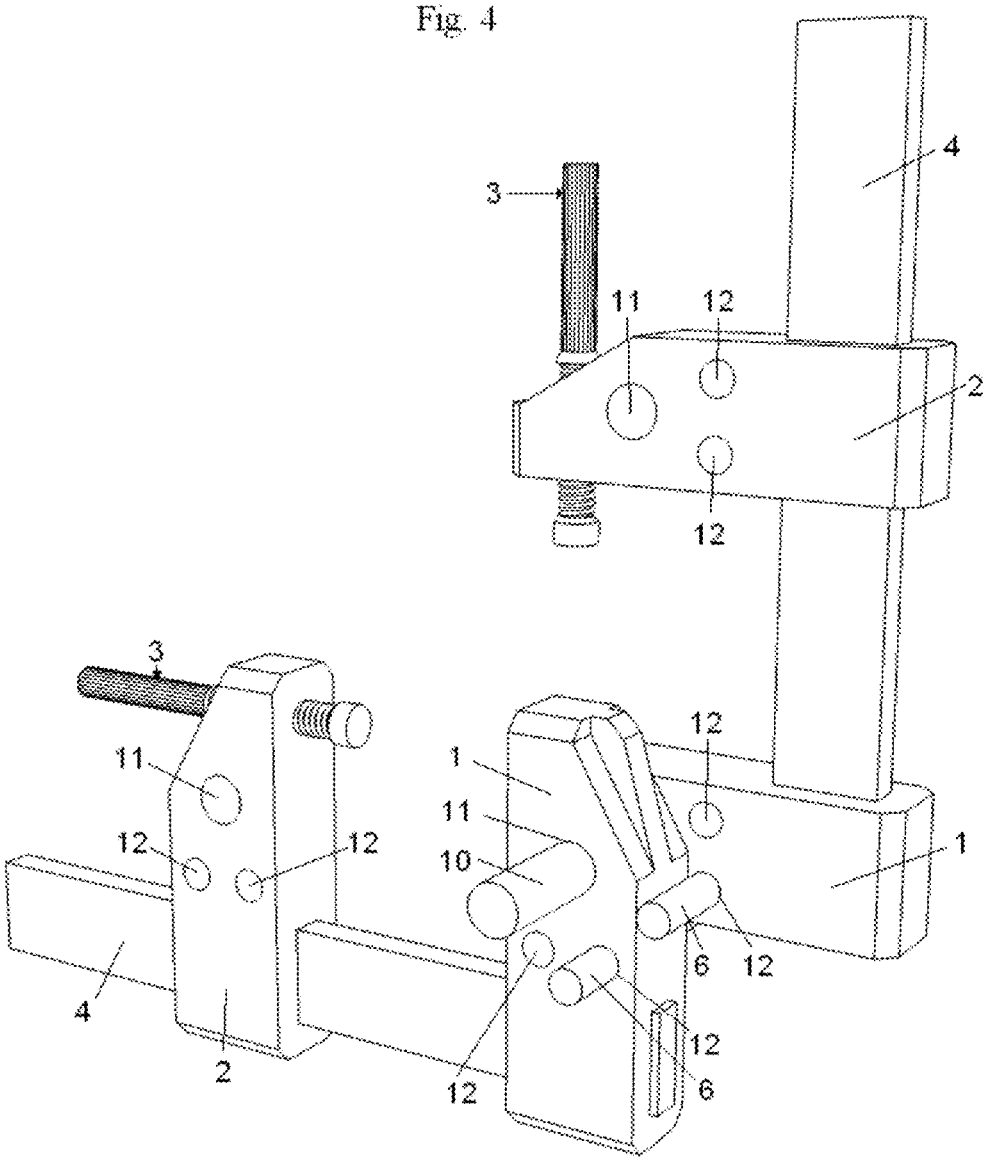
FIG. 4 shows a perspective view of two F-style clamps with removable cylindrical lugs joined at a 90-degree angle, with the lugs in the 90-degree position.

An illustration of the engagement of removable lugs 6 is depicted in FIG. 4, which illustrates two F-type bar clamps that have removable lugs 6, in this embodiment simple bars that may be fitted into several lug mounting holes 12 to vary the angle between clamps joined along a common bar 10. As in FIG. 3, the clamps are joined at a 90 degree angle; however, the clamps in FIG. 4 might also be joined at a 45 degree angle using the other set of lug mounting holes 12.

Figure 5:
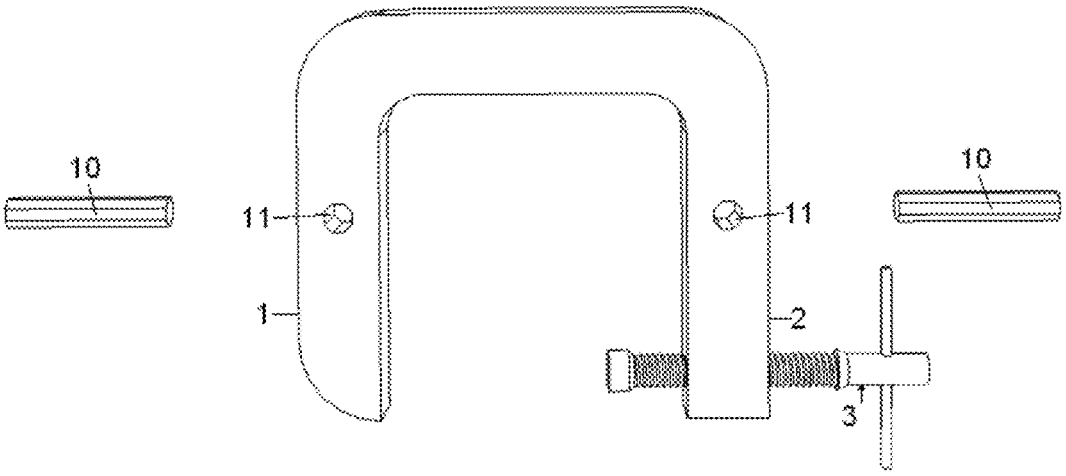
FIG. 5 shows a plan view of a C-clamp with octahedral connecting bars.

Properly shaped connecting bar 10 and corresponding holes 11 may be used in place of or in addition to lugs to resist rotation of clamps about connecting bar 10. A C-clamp is depicted in FIG. 5, distinguished from an F-type bar clamp by its rigid connection of the head 1 and foot 2 to the connecting structure 4. This C-clamp uses an octagonal profile bar 10 and hole 11 to permit clamps to be mounted at angles divisible by 45 and 90 degrees to one another along connecting bar 10.

Figure 6:
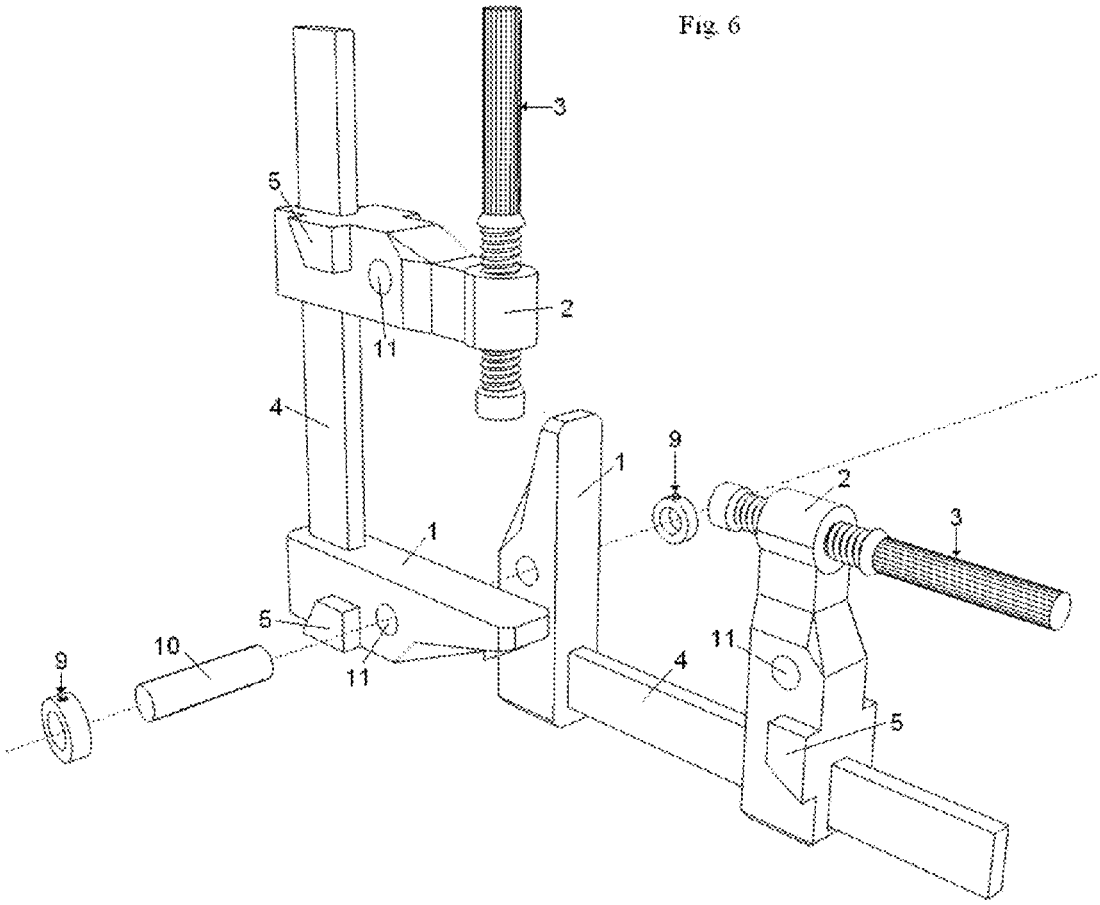
FIG. 6 shows a perspective view of two F-style clamps with fixed lugs and screw collar locks joined at a 90-degree angle.

To maintain the desired proximity of clamp heads 1 and clamp feet 2 along 10, screw collars 9 may be used as shown in FIG. 6, or for any embodiment incorporating a connecting bar 10 with the proper transverse profile.

Figure 7:
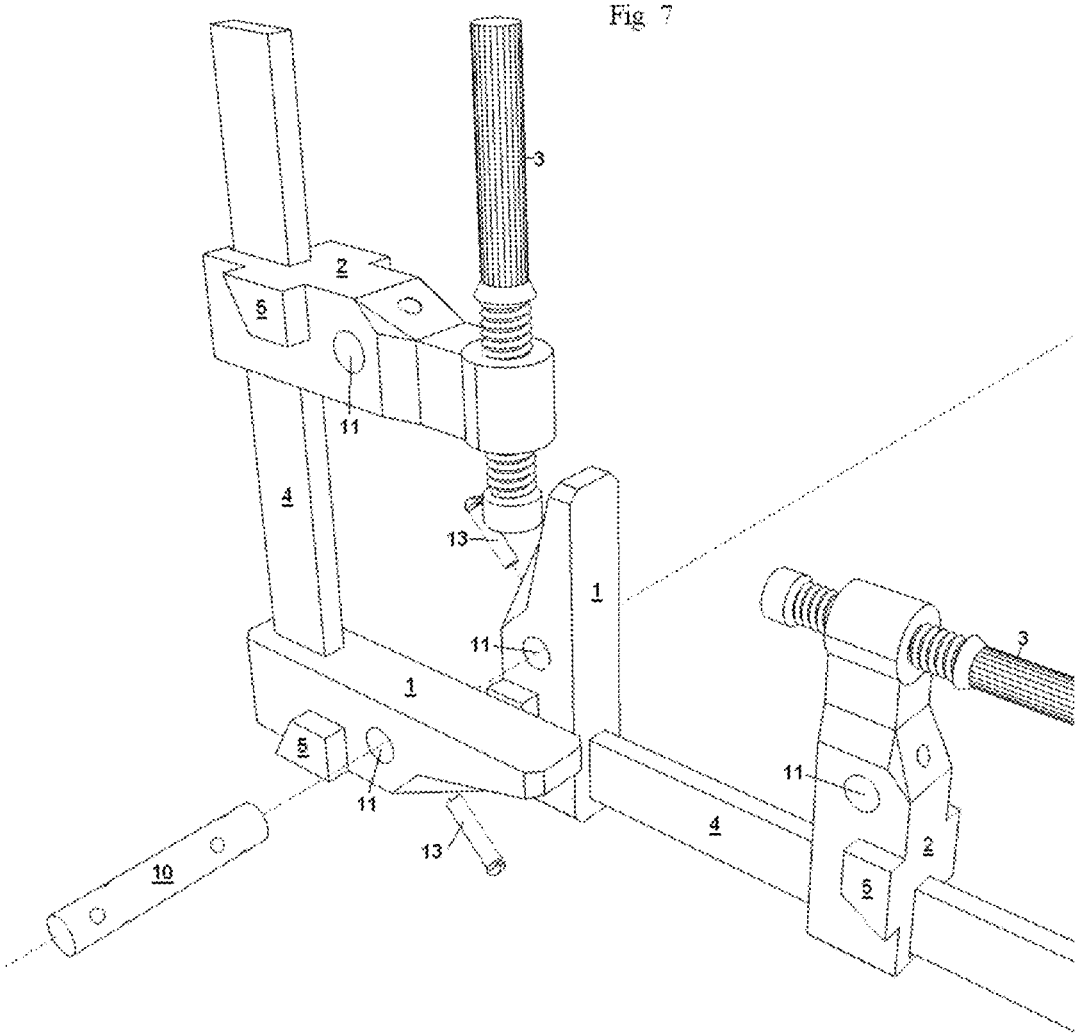
FIG. 7 shows a perspective view of two F-style clamps with fixed lugs and toggle locks joined at a 90-degree angle.
Figure 8:
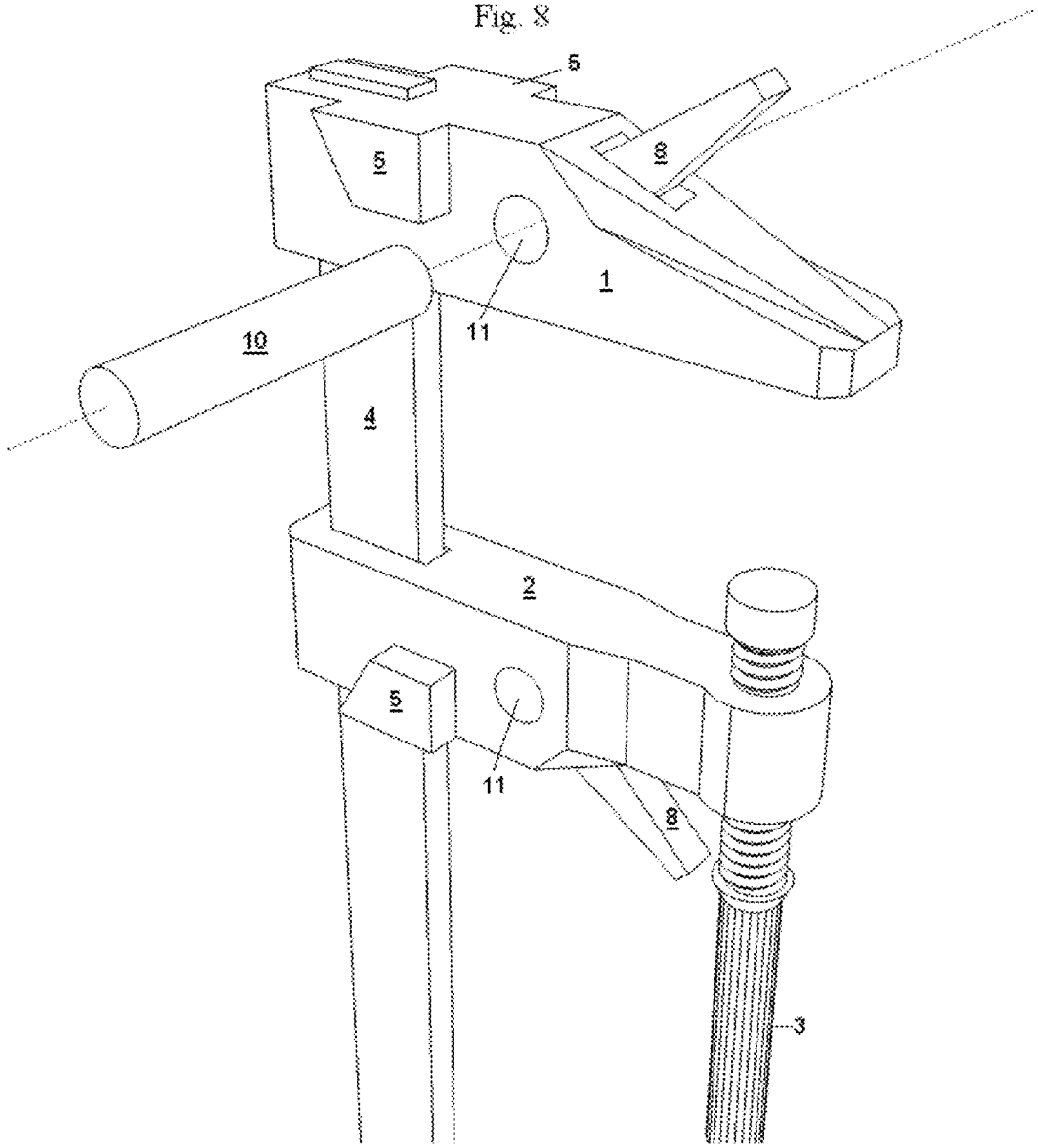
FIG. 8 shows a perspective view of a single F-style bar clamp with fixed side lugs and cam locks.
Figure 9:
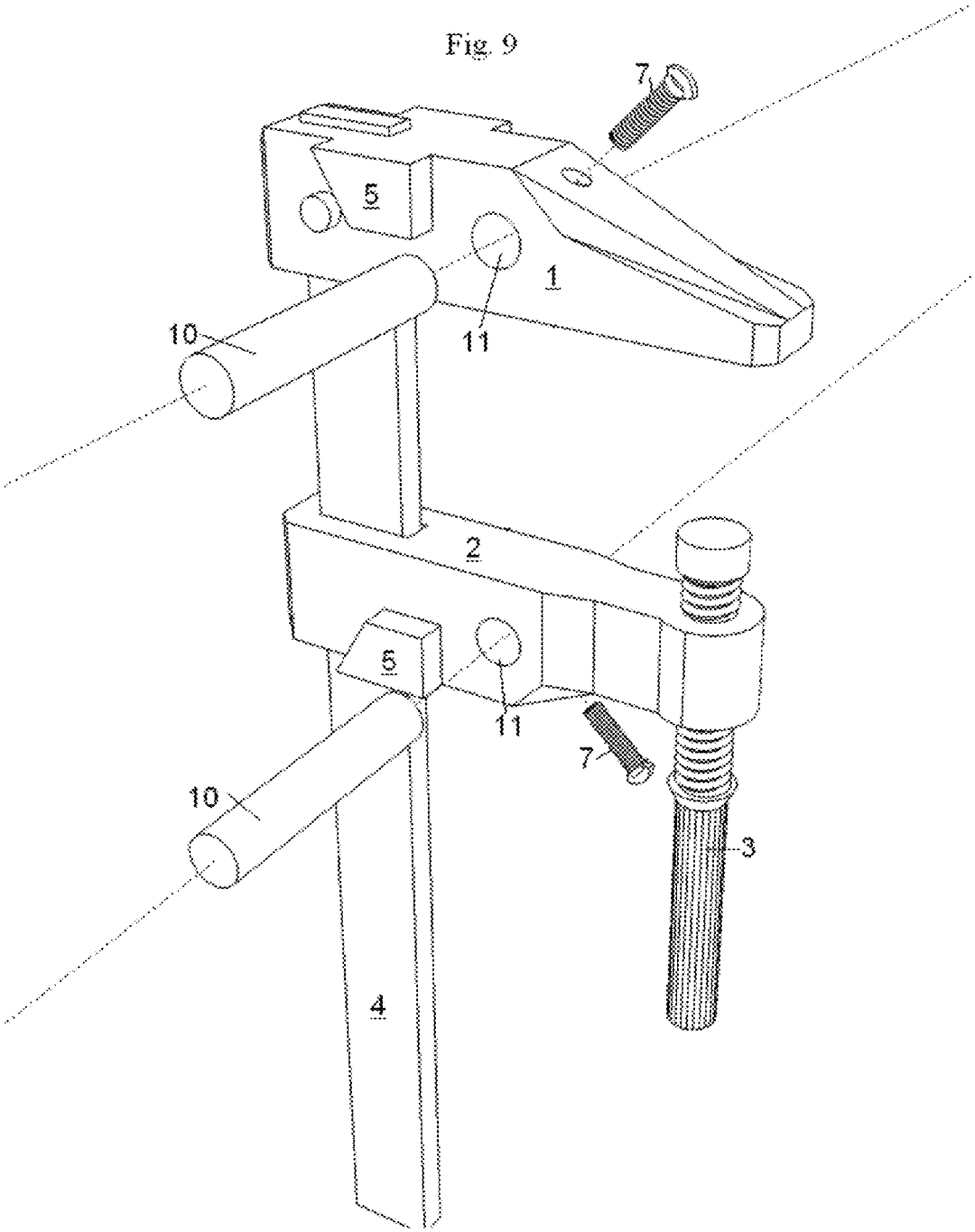
FIG. 9 shows a perspective view of a single F-style bar clamp with fixed side lugs and screw locks.

Other mechanisms may be used in place of or in addition to lugs to resist rotation of clamps about bar 10, or in some cases to resist movement of clamps along bar 10. FIG. 7 depicts another option for immobilizing the clamps relative to each other. Rather than a plain bar 10 as in FIGS. 1-4 and 6, the clamps depicted in FIG. 6 use a connecting bar 10 with holes drilled through its diameter, allowing use of a clevis pin 13 or toggle 13 to retain the angle of the clamps relative to each other and along the bar 10. FIG. 8 depicts a clamp with a cam lock 8 integral to the clamp head 1 and foot 2. When the cam lock is engaged, pressure of the cam on the bar 10 would lock the clamp in place along the connecting bar 10. This embodiment is suitable for lower-force applications, and has the advantage of quick deployment and removal of the locking force applied by the cam to connecting bar 10. FIG. 9 shows a related embodiment, simpler to manufacture, the clamp head 1 and foot 2 having a screw lock 7 to exert force on connecting bar 10 to resist motion of the clamp along the bar 10 and to provide a small amount of force to prevent rotation of the clamp around bar 10.

To sum up the basic design of the invention, clamps with the invention applied may be mounted together along one or more common axes provided by one or more connecting bars 10 connected to clamp heads 1 and feet 2 by means of holes 11. The interaction of bars 10 and holes 11 serves to maintain parallelism of the clamps' clamping force in the planes of workpieces held in the clamps.

Clamp heads 1 and feet 2 located along a common bar 10 may have fixed lugs 5 or removable lugs 6 such that if clamp heads 1 and feet 2 are placed side-to-side along a common bar 10, the lugs engage with adjacent heads 1 and feet 2 at a specific angle between clamps to resist force applied in at least one direction of rotation of the clamps about bar 10. Removable lugs 6 may have multiple possible mounting holes 12 in clamp heads 1 and feet 2 to provide several available angles.

Locking mechanisms 7, 8, 9, 13 and similar embodiments of the invention provide a means of temporarily fixing clamp heads 1 and feet 2 along a bar 10 and in some cases to resist force applied in at least one direction of rotation of the clamps about bar 10.

Different profiles of connecting bar 10 and corresponding holes 11 may be used to set angles between a plurality of clamps having a common bar 10, with the available angles being determined by the number of sides of the cross-sectional profile of bar 10; a 4-sided bar would permit angles divisible by 90, an 8-sided bar angles divisible by 45, and so on.

The preferred embodiment of the invention is that depicted in FIG. 1. This embodiment is simpler to produce than those with internal modifications to the clamp head and feet, such as that in FIG. 8, and does not require threading to be machined as does the embodiment in FIG. 9. It does not require special bar stock to be used for connecting bar 10; the unusual transverse profile of the bar 10 in FIG. 5 and the drilled bar 10 in FIG. 7 have the dual disadvantages of higher production cost and greater difficulty of procurement for the end user, while simple round bar stock is readily available. Additionally, use of round stock for bar 10 permits use of screw collars 9 as shown in FIG. 9. Finally, lugs are the strongest method of fixing an angle of adjacent clamps relative to each other against a force applied in at least one direction of turning about the unthreaded connecting bar 10. Use of removable lugs 6 in this embodiment permits a versatility that fixed lugs 5 do not permit.

The usefulness of this invention is considerably extended by squaring the butt ends of the clamp head and feet such that the clamp will lie level when placed on a flat surface with the workpiece atop it. This allows the use of the several clamps, joined together, as a base for a large workpiece and/or additional vertically mounted clamps. This invention would also work very well with Rockler-type "sure-foot" or similar clamps, which have an improved "foot" on their butt ends to maintain stability when used in this fashion.

What is claimed is:

1. In a system of clamps for exerting force on one or more workpieces, each of the clamps comprising two jaws extending from connecting structures, said jaws being about parallel and each jaw having a flat, planar surface capable of contacting one or more workpieces, for the holding of said workpieces by a linear compressive force exerted by the jaws of each clamp, this linear compressive force having a direction about perpendicular to the flat, planar surface of each jaw, in which the improvement comprises:

a hole in at least one of the jaws of each of the clamps, the hole being located on the same side of the connecting structure along the axis of projection of the jaw as the workpiece contacting the flat, planar surface of the jaw, the axis of the hole being perpendicular to the direction of extension of the penetrated jaw from the connecting structures, and perpendicular to the direction of the linear compressive force, and at least one unthreaded connecting bar, each bar passing through the hole in the single jaw of at least one of the clamps, such that the jaws of the clamp may slide along the axis of the connecting bar to various positions along the connecting bar and be removed from the connecting bar by sliding off of at least one end of the connecting bar, and at least one mechanism for fixing the relative angle of the jaws penetrated by the unthreaded connecting bar, the relative angle being fixed against a force applied to at least one of the jaws in at least one direction of turning about the axis of the unthreaded connecting bar.

2. The system of one or more clamps of claim 1, in which at least one of the mechanisms for fixing the relative angle of the jaws comprises at least one lug attached to or integral to at least one jaw of at least one clamp, the lug or lugs configured such that when two of the jaws, at least one of which has the integral or attached lug or lugs, are penetrated by the connecting bar, and are adjacent along the axis of the connecting bar, the lug or lugs and the jaws may engage each other, to fix the angle of the jaws relative to each other.

3. The system of one or more clamps of claim 2, in which at least one of the lug or lugs is permanently affixed to the jaw.

4. The system of one or more clamps of claim 1, in which the hole is present in both of the jaws of each of the clamps, such that the linear compressive force exerted by the jaws of the clamp with both of the jaws so transfixed will be parallel to the linear compressive force exerted by the jaws of another clamp with both of the jaws so transfixed by the same connecting bars.

5. The system of one or more clamps of claim 4, in which at least one of the mechanisms for fixing the relative angle of the jaws comprises at least one lug attached to or integral to at least one jaw of at least one clamp, the lug or lugs configured such that when two of the jaws, at least one of which has the integral or attached lug or lugs, are penetrated by the connecting bar, and are adjacent along the axis of the connecting bar, the lug or lugs and the jaws may engage each other, to fix the angle of the jaws relative to each other.

6. The system of one or more clamps of claim 5, in which at least one of the lug or lugs is permanently affixed to the jaw.

7. The system of one or more clamps of claim 1, in which the unthreaded connecting bar has a noncircular transverse profile.

8. In a system of clamps for exerting force on one or more workpieces, each of the clamps comprising two jaws extending from a mounting bar, said jaws being about parallel and each jaw having a flat, planar surface capable of contacting one or more workpieces, with at least one jaw slidably fitted about the mounting bar, for the holding of said workpieces by a linear compressive force exerted by the jaws of each clamp, this force having a linear direction about perpendicular to the flat, planar surface of each jaw, in which the improvement comprises:

a hole in at least one jaw of each of the clamps, the hole being located on the same side of the mounting bar along the axis of projection of the jaw as the workpiece contacting the flat, planar surface of the jaw, the axis of the hole being perpendicular to the direction of extension of the penetrated jaw from the mounting bar, and perpendicular to the direction of the linear compressive force, and at least one unthreaded connecting bar, each bar passing through the hole in the single jaw of at least one clamp, such that the jaws of the clamp may slide along the axis of the connecting bar to various positions along the connecting bar and be removed from the connecting bar by sliding off of at least one end of the connecting bar, and at least one mechanism for fixing the relative angle of the jaws penetrated by the unthreaded connecting bar, the relative angle being fixed against a force applied to at least one of the jaws in at least one direction of turning about the axis of the unthreaded connecting bar.

9. The system of one or more clamps of claim 8, in which at least one of the mechanisms for fixing the relative angle of the jaws comprises at least one lug attached to or integral to at least one jaw of at least one clamp, the lug or lugs configured such that when two of the jaws, at least one of which has the integral or attached lug or lugs, are penetrated by the connecting bar, and are adjacent along the axis of the connecting bar, the lug or lugs and the jaws may engage each other, to fix the angle of the jaws relative to each other.

10. The system of one or more clamps of claim 9, in which at least one of the lug or lugs is permanently affixed to the jaw.

11. The system of one or more clamps of claim 8, in which at least one of the mechanisms for fixing an angle of the jaws is selected from a group consisting of a cam lock, a screw lock, and a clevis pin.

* * * * *